US011441311B1

(12) United States Patent
Gant et al.

(10) Patent No.: US 11,441,311 B1
(45) Date of Patent: Sep. 13, 2022

(54) DYNAMICS MANAGEMENT SYSTEM FOR A STRUCTURE USING TENSION AND RESISTANCE ELEMENTS

(71) Applicant: United States of America as represented by the Administrator of NASA, Washington, DC (US)

(72) Inventors: Frederick Scott Gant, Huntsville, AL (US); Robert E. Berry, Madison, AL (US); Jeffrey Lee Lindner, Madison, AL (US)

(73) Assignee: United States of America as represented by the Administrator of NASA, Washington, DC (US)

( * ) Notice: Subject to any disclaimer, the term of this patent is extended or adjusted under 35 U.S.C. 154(b) by 56 days.

(21) Appl. No.: 17/218,944

(22) Filed: Mar. 31, 2021

(51) Int. Cl.
*E04B 1/98* (2006.01)

(52) U.S. Cl.
CPC ..... *E04B 1/98* (2013.01)

(58) Field of Classification Search
CPC ..... E04B 1/98; F16F 15/022; F16F 15/1201; F16F 2222/04; F16F 2222/06; F16F 2222/12; F16F 2232/02; F16F 2232/08
See application file for complete search history.

(56) References Cited

U.S. PATENT DOCUMENTS 2,053,226 A * 9/1936 Ruge ..... E04H 9/0237 52/693
3,418,768 A * 12/1968 Cardan ..... E04H 9/0235 188/312
4,922,667 A * 5/1990 Kobori ..... E04H 9/0237 52/167.2
4,941,640 A 7/1990 Nakamura et al.
5,036,633 A * 8/1991 Kobori ..... E04H 9/0237 52/167.2
5,065,552 A * 11/1991 Kobori ..... E04H 9/0235 52/167.3
5,259,159 A 11/1993 Kawase et al.
5,347,771 A * 9/1994 Kobori ..... E04H 9/0235 188/312
5,491,938 A * 2/1996 Niwa ..... E04H 9/0237 52/167.3
5,791,097 A 8/1998 Winston et al.
6,233,884 B1 * 5/2001 Tipping ..... E04H 9/0237 52/167.4
6,397,528 B1 * 6/2002 Rahimian ..... E04H 9/0237 52/167.3

(Continued)

*Primary Examiner* — Rodney Mintz
(74) *Attorney, Agent, or Firm* — Jacob A. Heafner; Jerry L. Seemann; Helen M. Gaius

(57) ABSTRACT

A dynamics management system for a structure includes a line whose first end is coupled to a first location within a structure. A tension resistance device is coupled to a second location within the structure. The tension resistance device generates a first force when a tension force is applied thereto and generates a lesser second force when the tension force is not applied thereto. The second end of the line is coupled to the tension resistance device wherein the first force is applied to the line when it is in tension and the second force is applied to the line when it is not in tension. The line traverses at least one Z-shaped path within and in a plane of the structure. The line is coupled to the structure at each inflection point of the Z-shaped path(s) for supporting movement of the line there along.

16 Claims, 4 Drawing Sheets

(56) References Cited

U.S. PATENT DOCUMENTS

| | | | | |
|---|---|---|---|---|
| 10,352,058 | B2 * | 7/2019 | Towfighi | E04B 1/36 |
| 11,041,539 | B1 * | 6/2021 | Myers | F16F 15/023 |
| 11,078,984 | B1 * | 8/2021 | Gant | F16F 15/1201 |
| 2011/0138704 | A1 | 6/2011 | Bagepalli et al. | |
| 2018/0044937 | A1 * | 2/2018 | Shyta | E04H 9/0237 |
| 2018/0334824 | A1 * | 11/2018 | Towfighi | E04B 1/18 |
| 2018/0334826 | A1 * | 11/2018 | Towfighi | E04H 9/0237 |

* cited by examiner

DYNAMICS MANAGEMENT SYSTEM FOR A STRUCTURE USING TENSION AND RESISTANCE ELEMENTS

ORIGIN OF THE INVENTION

The invention described herein was made in the performance of work under a NASA contract and by an employee of the United States Government and is subject to the provisions of Public Law 96-517 (35 U.S.C. § 202) and may be manufactured and used by or for the Government for governmental purposes without the payment of any royalties thereon or therefore.

BACKGROUND OF THE INVENTION

1. Field of the Invention

This invention relates to damping systems. More specifically, the invention is a system that manages dynamic motion of a structure using a tension element and a resistance element mounted within the structure.

2. Description of the Related Art

A variety of load bearing structures can exhibit flexibility along axial planes thereof that are not aligned with a structure's primary load bearing axis. This flexibility can give rise to structure motion or dynamic oscillation that can ultimately lead to performance loss or structural damage. This is especially true when there is an external driving force causing the motion or dynamic oscillation of the structure. Examples of such structures include wind turbine blades that can "flap" when stationary or rotating, a rocket engine oscillating in a pendulum mode with respect to its corresponding vehicle stage, and towers (e.g., cranes, cell phone towers, etc.) experiencing bending oscillation due to wind-induced vortex shedding.

Conventional approaches to dealing with a structure's off-load-axis flexibility include designing the structure in a way that limits performance of the system it is part of, adding reinforcement to a structure to limit its flexibility, and/or adding mass/mechanisms to change the structure's dynamic behavior. The first approach essentially prevents optimal performance, while the second and third approaches can add weight and cost to the structure.

SUMMARY OF THE INVENTION

Accordingly, it is an object of the present invention to provide a dynamics management system for structures.

Another object of the present invention is to provide a dynamics management system configurable for a variety of elongate structures.

Still another object of the present invention is to provide a dynamics management system for structures that is simple, lightweight, and cost efficient.

Other objects and advantages of the present invention will become more obvious hereinafter in the specification and drawings.

In accordance with the present invention, a dynamics management system for a structure includes a line having a first end and a second end with the first end of the line being coupled to a first location within a structure. A tension resistance device is coupled to a second location within the structure. The tension resistance device generates a first force when a tension force is applied thereto and generates a second force when the tension force is not applied thereto. The first force is greater than the second force. The second end of the line is coupled to the tension resistance device wherein the first force is applied to the line when the line is in tension, and wherein the second force is applied to the line when the line is not in tension. The line traverses at least one Z-shaped path within and in a plane of the structure. The line is coupled to the structure at each inflection point of the at least one Z-shaped path for supporting movement of the line there along.

BRIEF DESCRIPTION OF THE DRAWING(S)

Other objects, features and advantages of the present invention will become apparent upon reference to the following description of the preferred embodiments and to the drawings, wherein corresponding reference characters indicate corresponding parts throughout the several views of the drawings and wherein.

DESCRIPTION OF THE PREFERRED EMBODIMENT(S)

Figure 1:
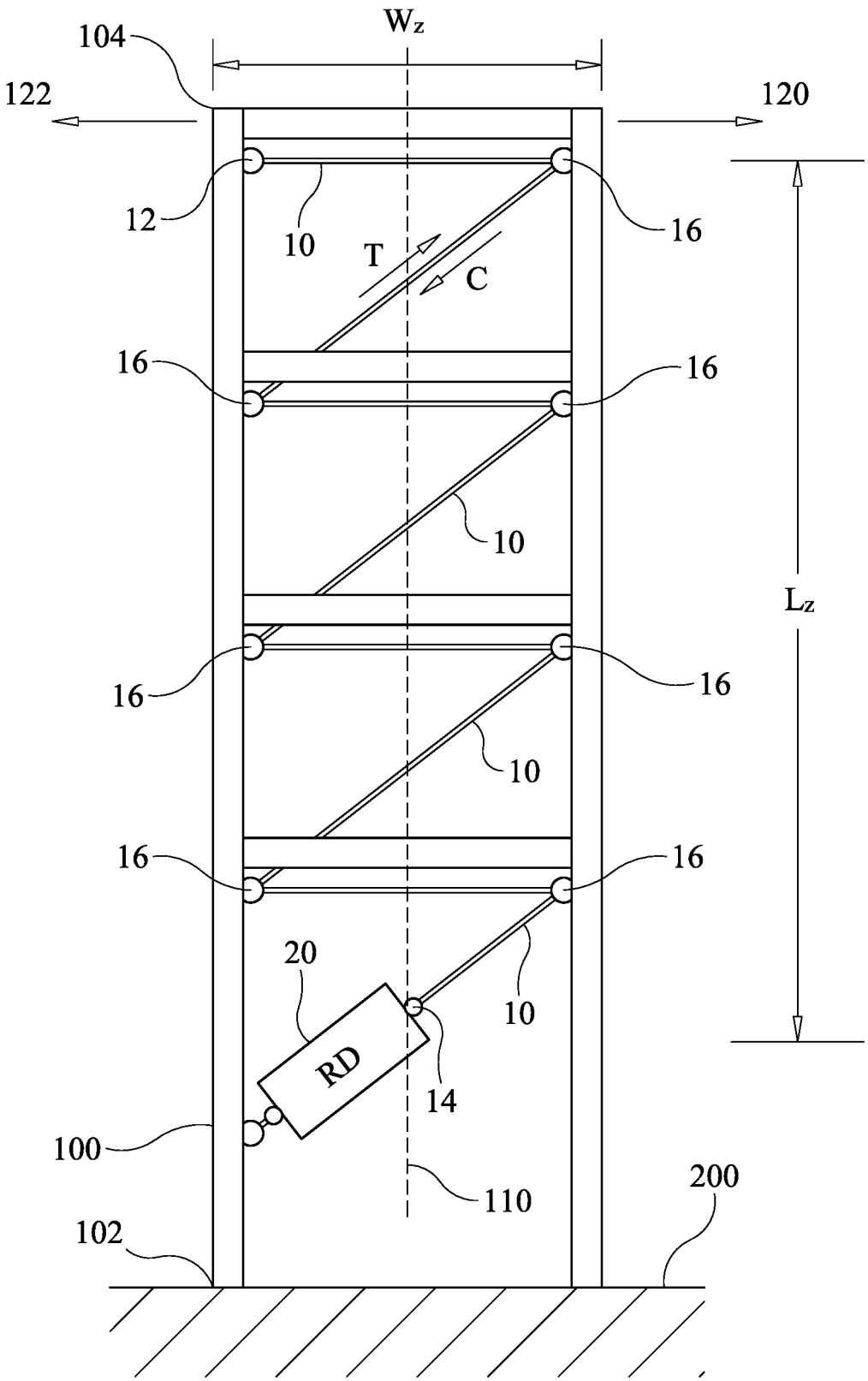
FIG. 1 is a schematic view of a dynamics management system for a structure in accordance with an embodiment of the present invention.

Referring now to the drawings and more particularly to FIG. 1, a dynamics management system for controlling oscillations of a structure 100 in accordance with an embodiment of the present invention is illustrated schematically. Structure 100 is generally an elongate structure fixed at one axial end 102 to a support 200 and free at its other axial end 104. Structure 100 can be any of a variety of elongate structures to include wind turbine blades, rocket engines, crane booms, cell phone towers, etc. Support 200 varies in correspondence with the type of structure 100 being supported. It is to be understood that structure 100 and its support 200 are not limitations of, or a part of, the present invention.

In general, structure 100 is designed to have a load bearing axis 110. However, structure 100 can be subject to outside forces such as wind that cause structure 100 to oscillate or vibrate in an axial plane of structure 100 that is not aligned with its load bearing axis 110. In the illustrated example, it is assumed that structure 100 is prone to oscillations in the plane of the paper (referred to hereinafter as the plane of oscillation) where the oscillating motion is indicated by right-pointing arrow 120 and left-pointing arrow 122. As will be explained below, the dynamics management system of the present invention controls/damps oscillating motion 120/122 of structure 100.

The dynamics management system of the present invention is disposed within structure 100 and includes a line 10 and a resistance device ("RD") 20. Line 10 should exhibit rigidity when it is placed in tension and should exhibit flexibility when it is placed in compression. For example, line 10 can be a rope, wire, strap, metal cable, a cable made from composite material(s), or a cable made from a combination of metal and composite materials. In other embodiments of the present invention, line 10 can be constructed from a combination of the above-noted elements and/or can include rigid rod(s) along the length thereof where the resulting line 10 supports the functions thereof as described herein. Accordingly, it is to be understood that a variety of constructions for line 10 can be used without departing from the scope of the present invention.

Line 10 is fixed at one end 12 to structure 100 at an interior location thereof and is fixed at its other end 14 to resistance device 20. Along its length, line 10 traverses one or more Z-shaped paths having inflection points 16 wherever line 10 changes direction. At each inflection point 16, line 10 is coupled to structure 100 in a way that supports movement of line 10 along its Z-shaped path when structure 100 experiences oscillating motion 120/122. A variety of such couplings/supports can be used without departing from the scope of the present invention. Several examples of such couplings/supports will be described further below. The number of Z-shaped paths depends on the nature of structure 100, the types of oscillations that are to be managed, and/or the magnitude of the oscillations that are to be managed.

The one or more Z-shaped paths of line 10 lie in the plane of oscillation of structure 100 that is indicated by oscillating motion arrows 120/122. If multiple Z-shaped paths are traversed by line 10, they are successively aligned. The length ("Lx") of the Z-shaped path(s) can span some or all of the length of structure 100. The width ("Wz") of the Z-shaped path(s) can span some or all of the width of structure 100. The angle made between legs of a Z-shaped path at each inflection point 16 can be an acute, right, or obtuse angle without departing from the scope of the present invention. The period of repeat for multiple Z-shaped paths can be the same or varied along the path length $L_z$ without departing from the scope of the present invention. Although not shown, additional dynamics management systems in accordance with the present invention can be provided in structure 100 to manage other planes of oscillation of structure 100.

Resistance device 20 is mounted within structure 100 at a fixed location therein. As mentioned above, end 14 of line 10 is coupled to resistance device 20. In general, resistance device 20 constantly applies a varying force to line 10 at end 14 in response to the amount of tension or lack thereof in line 10. As tension in line 10 increases, so does the resistance force applied by resistance device 20. When tension in line 10 is not present (i.e., line 10 is in compression), the resistance force applied by resistance device 20 is a much lower restoring force that prevents zero tension or slack in line 10. A variety of devices could be used for resistance device 20. Some non-limiting examples include linear hydraulic or magnetic dampers having a return spring(s), pneumatic spring dampers with vent valves, or spooled rotating mechanisms.

In operation, when structure 100 experiences motion 120, line 10 is placed in tension "T" such that resistance device 20 responds with its resistance force to restrain/damp motion 120. As structure 100 experiences motion 122, line 10 is no longer in tension as it experiences compression "C". As a result, resistance device 20 responds with its lower restoring force to prevent slack from developing in line 10.

Figure 2:
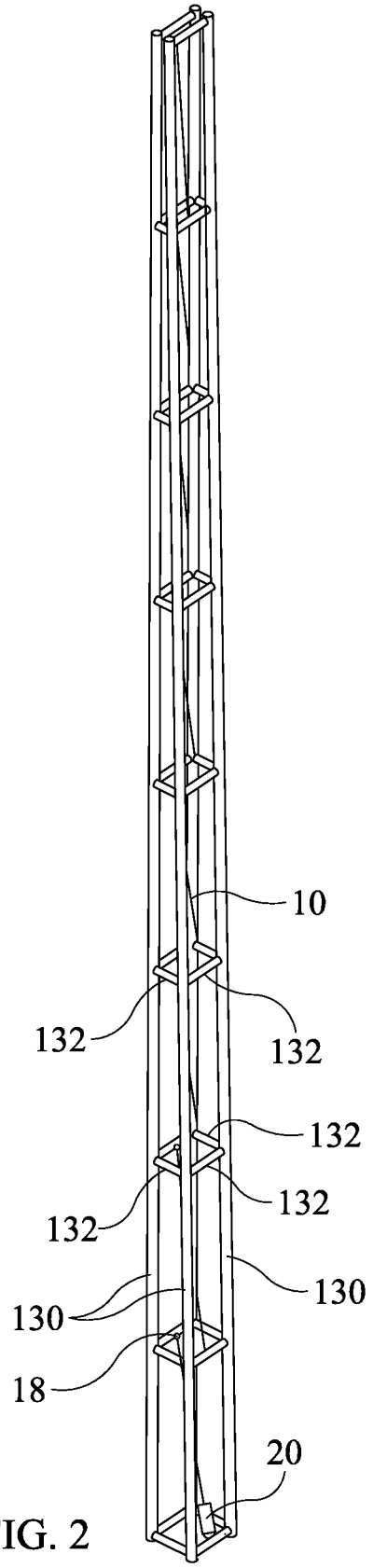
FIG. 2 is a perspective view of an elongate structure's frame with a dynamics management system provided therein in accordance with an embodiment of the present invention.
Figure 3:
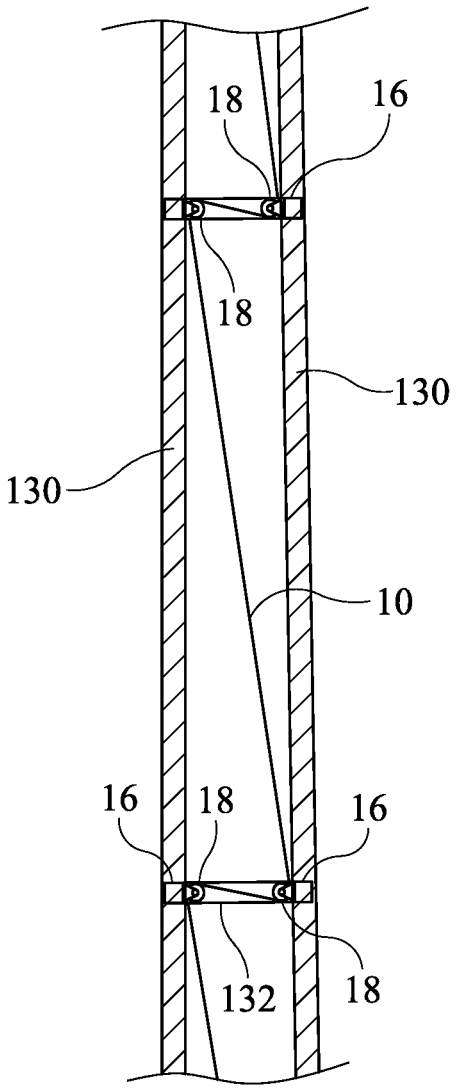
FIG. 3 is a cross-sectional view of a portion of the frame illustrated in FIG. 2 depicting one Z-shaped path of the dynamic management system's line using pulleys at each inflection point thereof.

Referring now simultaneously to FIGS. 2-3, an exemplary embodiment of the present invention for cooperation with a structure's frame is illustrated. In the illustrated embodiment, each inflection point 16 of line 10 has a pulley 18 located at the juncture of a length-wise frame member 130 and a cross-member 132. Each pulley 18 is fixed to the juncture and allows line 10 to move along its Z-shaped path as line 10 experiences tension T or compression C in correspondence with oscillating motions 120/122.

Figure 4A:
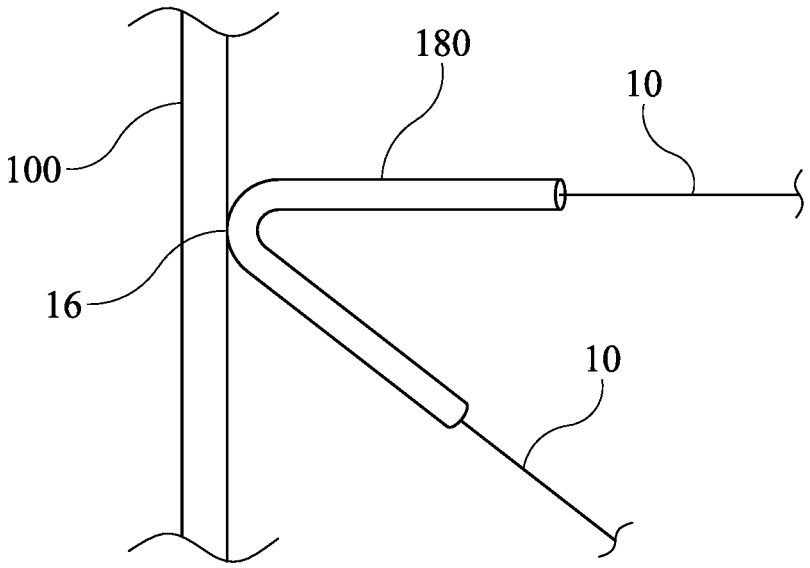
FIG. 4A is a perspective view of a fixed line shaping device for use at the Z-shaped path's inflection points in accordance with another embodiment of the present invention.
Figure 4B:
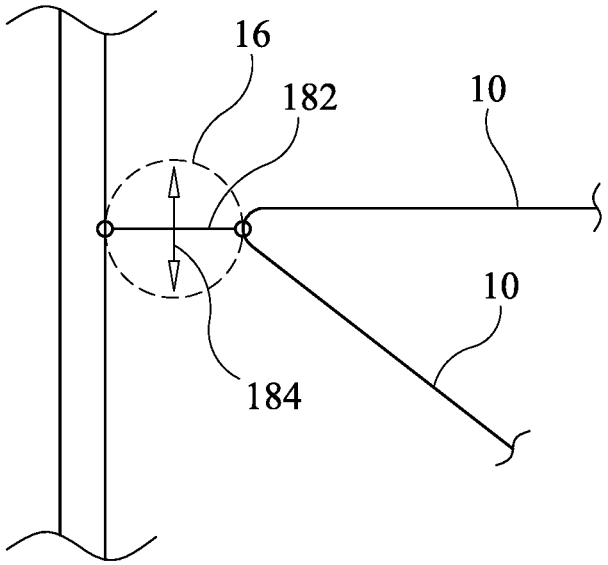
FIG. 4B is a schematic view of a flexible element for use at the Z-shaped path's inflection points in accordance with another embodiment of the present invention.

Inflection points 16 can be created by devices other than pulleys without departing from the scope of the present invention. For example, FIG. 4A illustrates a fixed line shaping device such as a rigid tube 180 coupled to structure 100 at an inflection point 16. Tube 180 is configured to control the change of direction of line 10 at inflection point 16 and to support the sliding movement of line 10 during oscillating motions 120/122. Another type of inflection point creating device is illustrated in FIG. 4B where a flexible element 182 is rigidly coupled to structure 100 and to line 10 at inflection point 16. In this example, movement of line 10 along its Z-shaped path is facilitated by the flexing motion of element 182 as indicated by two-headed arrow 184.

Figure 5:
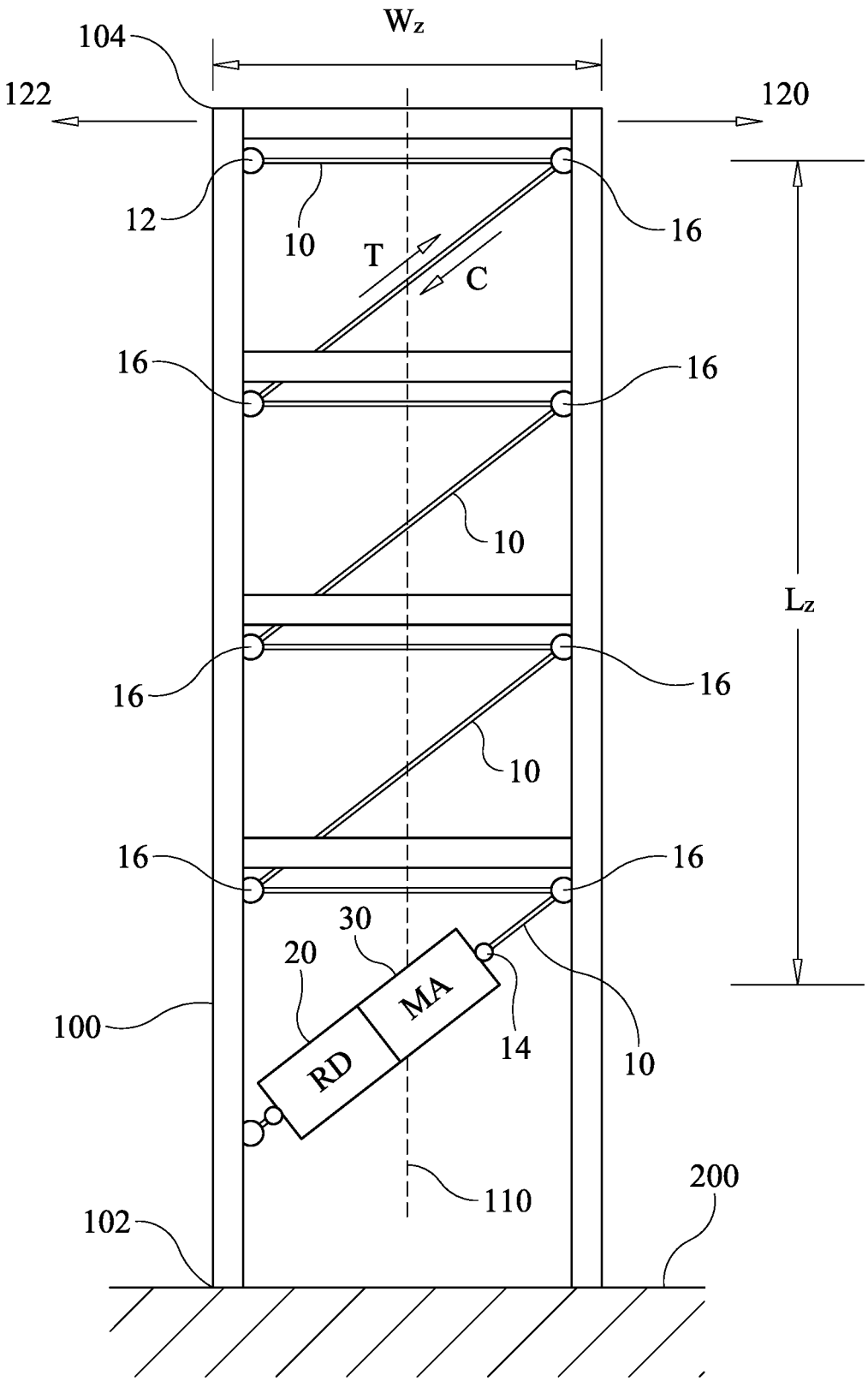
FIG. 5 is a schematic view of a dynamics management system for a structure that includes a line movement amplifier in accordance with another embodiment of the present invention.

For some applications, the amount of movement of line 10 during a structure's oscillations may need to be positively or negatively amplified for proper operation of resistance device 20. In such cases, the present invention can include one or more motion amplifiers in-line with line 10. By way of an illustrative example, a single motion amplifier ("MA") 30 is shown in FIG. 5 coupled between end 14 of line 10 and resistance device 20. Additionally or alternatively, motion amplifiers could be disposed in-line and along line 10 without departing from the scope of the present invention. In all cases, positively or negatively amplified movement of line 10 is ultimately applied to resistance device 20. A variety of mechanical motion amplifiers can be used without departing from the scope of the present invention. Some non-limiting examples of motion amplifier 30 include a lever or system of levers, a small diameter pulley coupled to a large diameter pulley, a cam mechanism, etc.

The advantages of the present invention are numerous. The integration of tensile resistances as a means to control a structure's dynamic behavior adds relatively small amounts of mass and complexity to a structure. The present invention can be readily incorporated into new or existing structures. The present invention can be adapted and incorporated into a variety of blade, boom, tower, and/or bridge structures as a means to address unwanted dynamic behavior.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A dynamics management system for a structure, comprising:

a line exhibiting rigidity in tension and flexibility in compression, said line including a first end and a second end, said first end configured to be coupled to a first location within the structure, said line traversing at least one Z-shaped path within the structure wherein said at least one Z-shaped path lies in a plane, each said Z-shaped path having a plurality of inflection points defined there along;

a line support coupled to the structure at each of said inflection points for supporting movement of said line along said at least one Z-shaped path; and a tension resistance device configured to be coupled to a second location within the structure and coupled to said second end of said line for applying a resistance force to said line when said line is in tension and for applying a restoring force to said line when said line is in compression, wherein said restoring force is less than said resistance force;

wherein the structure is an elongate structure subject to oscillating motion in said plane of said at least one Z-shaped path.

2. The dynamics management system as in claim 1, wherein said at least one Z-shaped path comprises a plurality of Z-shaped paths in succession.

3. The dynamics management system as in claim 1, wherein each said line support is selected from the group consisting of pulleys, rigid line shaping devices, and flexible elements rigidly coupled to said line and adapted to be rigidly coupled to the structure.

4. The dynamics management system as in claim 1, wherein said line comprises at least one of a rope, a wire, a strap, and a cable.

5. The dynamics management system as in claim 1, further comprising at least one device in-line with said line for amplifying said movement of said line and for applying an amplified amount of said movement to said tension resistance device.

6. A dynamics management system for a structure, comprising:

a line having a first end and a second end, said first end of said line configured to be coupled to a first location within the structure;

a tension resistance device configured to be coupled to a second location within the structure, said tension resistance device generating a first force when a tension force is applied thereto and generating a second force when said tension force is not applied thereto wherein said first force is greater than said second force;

said second end of said line coupled to said tension resistance device wherein said first force is applied to said line when said line is in tension, and wherein said second force is applied to said line when said line is not in tension; and said line traversing at least one Z-shaped path within the structure, wherein said at least one Z-shaped path lies in a plane of the structure, said line being coupled to the structure at each inflection point of said at least one Z-shaped path for supporting movement of said line there along;

wherein the structure is an elongate structure subject to oscillating motion in said plane of said at least one Z-shaped path.

7. The dynamics management system as in claim 6, wherein said at least one Z-shaped path comprises a plurality of Z-shaped paths in succession.

8. The dynamics management system as in claim 6, wherein said line comprises at least one of a rope, a wire, a strap, and a cable.

9. The dynamics management system as in claim 6, further comprising at least one device in-line with said line for amplifying movement of said line along said at least one Z-shaped path and for applying an amplified amount of said movement to said tension resistance device.

10. The dynamics management system as in claim 6, further comprising line supports coupled to the structure and positioned at each said inflection point for supporting said movement of said line.

11. The dynamics management system as in claim 10, wherein each of said line supports is selected from the group consisting of pulleys, rigid line shaping devices, and flexible elements rigidly coupled to said line and adapted to be rigidly coupled to the structure.

12. A dynamics management system for an elongate structure, comprising:

a line having a first end and a second end, said first end of said line configured to be coupled to a first location within the elongate structure;

a tension resistance device configured to be coupled to a second location within the elongate structure, said tension resistance device generating a first force when a tension force is applied thereto and generating a second force when said tension force is not applied thereto wherein said first force is greater than said second force;

said second end of said line coupled to said tension resistance device wherein said first force is applied to said line when said line is in tension, and wherein said second force is applied to said line when said line is not in tension; and said line traversing a plurality of successive Z-shaped paths within the elongate structure, wherein said Z-shaped paths lie in a plane of the elongate structure that is subject to oscillating motion, said line being coupled to the structure at each inflection point of said Z-shaped paths for supporting movement of said line there along.

13. The dynamics management system as in claim 12, wherein said line comprises at least one of a rope, a wire, a strap, and a cable.

14. The dynamics management system as in claim 12, further comprising at least one device in-line with said line for amplifying movement of said line along said Z-shaped paths and for applying an amplified amount of said movement to said tension resistance device.

15. The dynamics management system as in claim 12, further comprising line supports coupled to the structure and positioned at each said inflection point for supporting said movement of said line.

16. The dynamics management system as in claim 15, wherein each of said line supports is selected from the group consisting of pulleys, rigid line shaping devices, and flexible elements rigidly coupled to said line and adapted to be rigidly coupled to the elongate structure.

* * * * *